United States Patent [19]

Malafosse et al.

[11] 4,310,394

[45] Jan. 12, 1982

[54] PROCESS FOR PREPARING PEROXYDISULFATES OF ALKALI METALS AND AMMONIUM

[75] Inventors: Jean Malafosse, Sassenage; Maurice Rignon, Champforgeuil, both of France

[73] Assignee: L'Air Liquide, Societe Anonyme pour l'Etude et l'Exploitation des Procedes Georges Claude, Paris, France

[21] Appl. No.: 225,456

[22] Filed: Jan. 15, 1981

Related U.S. Application Data

[63] Continuation of Ser. No. 71,583, Aug. 30, 1979, abandoned.

[30] Foreign Application Priority Data

Aug. 30, 1978 [FR] France ..... 78 24977

[51] Int. Cl.[3] ..... C25B 1/28

[52] U.S. Cl. ..... 204/82; 204/93

[58] Field of Search ..... 204/82, 83, 92, 93, 204/180 P, 252

[56] References Cited

U.S. PATENT DOCUMENTS

| | | | |
|---|---|---|---|
| 2,921,005 | 1/1960 | Bodamer | 204/180 P X |
| 3,616,325 | 10/1971 | Mucenieks | 204/82 |
| 4,100,050 | 7/1978 | Cook, Jr. et al. | 204/252 |
| 4,127,456 | 11/1978 | Radimer | 204/82 |

FOREIGN PATENT DOCUMENTS

| | | |
|---|---|---|
| 1086235 | 2/1955 | France . |
| 2253105 | 6/1975 | France . |

*Primary Examiner*—Arthur C. Prescott
*Attorney, Agent, or Firm*—Browdy and Neimark

[57] ABSTRACT

A process for preparing peroxydisulfates by electrolysis in a diaphragm cell uses a diaphragm, the active part of which comprises a cation exchange polymer made up of a membrane with a sulfonated polystyrene base resin supported by a polypropylene fabric. The process is applicable to the preparation of peroxydisulfates of alkali metals and of ammonium.

6 Claims, 1 Drawing Figure

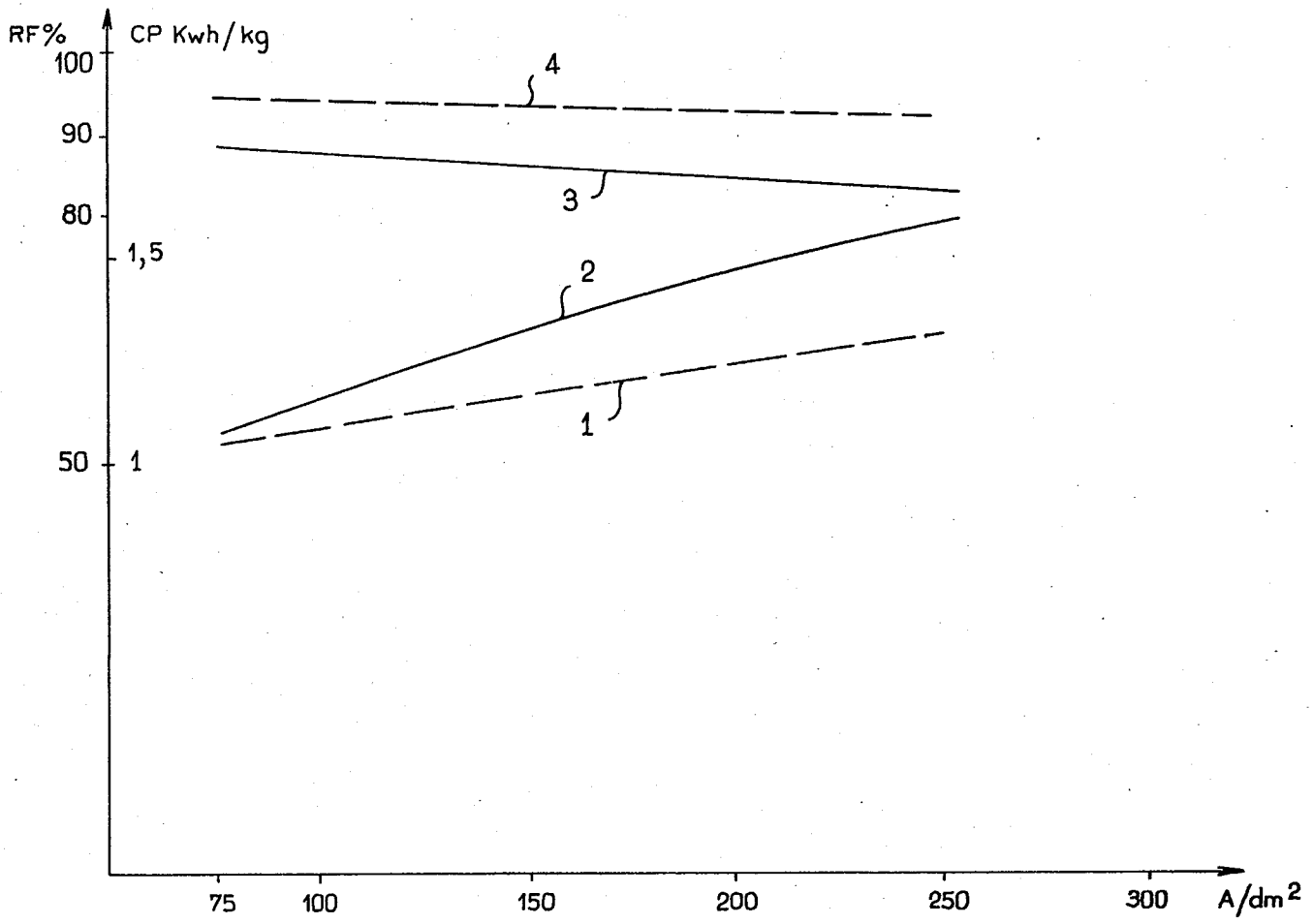
RF%
100
90
80
CP Kwh/kg
1,5
50
1
4
3
2
1
75
100
150
200
250
300
A/dm2

PROCESS FOR PREPARING PEROXYDISULFATES OF ALKALI METALS AND AMMONIUM

This is a continuation of application Ser. No. 071,583 filed Aug. 30, 1979 now abandoned.

FIELD OF INVENTION

The present invenion relates to a process of preparing peroxydisulfates of alkali metals or ammonium by electrolysis.

BACKGROUND OF THE INVENTION

It is known that sulfate ion oxidation in an aqueous acid medium leads to the formation of peroxydisulfate ion; the main reactions are: at the anode $$2\ SO_4^{--} \rightarrow S_2O_8^{--} + 2\ e^-$$

at the cathode $$2\ H^+ + 2\ e^- \rightarrow H_2$$

The secondary reactions that disturb this phenomenon and reduce the current efficiency (or Faraday efficiency) are:

1st—electrolysis of the water which leads to the formation of oxygen at the anode and hydrogen at the cathode;

2nd—acid hydrolysis of the perosydisulfate ion into peroxydisulfate ion (or Caro's acid)

$$S_2O_8^{--} + H_2O \xrightarrow{H^+} HSO_5^- + HSO_4^-;$$

3rd—reduction on the cathode of the $S_2O_8^{--}$ ion $$S_2O_8^{--} + 2\ e^- \rightarrow 2\ SO_4^{--}$$

It is known how to limit the first secondary reaction by using suitable anode materials, i.e. anode materials exhibiting the strongest oxygen excess pressure at zero current; platinum or platinum group metals such as ruthenium or metal oxides such as $PbO_2$, $RuO_2$, $MnO_2$ are used. Addition of small amounts of compounds such as sulfocyanide ion, urea, etc., also makes it possible to restirct the first secondary reaction probably by modification of the adsorption properties of the platinum anode.

Control of the second secondary reaction can be assured by limiting the anolyte temperature to a sufficiently low value so that the hydrolysis rate will be slight, however, without greatly increasing the electric resistance of the electrolyte which would cause, with an equal current efficiency, a higher electric energy consumption.

To avoid the third secondary reaction, more or less satisfactory processes are used. In a first type process, the anode and cathode compartments are separated by a porous porcelain diaphragm which actually constitutes only a mechanical barrier that is hardly fluid-tight with regard to the persulfate ion, the cathode material used is lead; but as this metal is attacked in an oxidizing acid medium, in the case of continuous operation, it is necessary to operate with two circuits of liquid so that the cathode compartments are fed with persulfate-free aqueous solutions, which causes an efficiency loss.

In a second embodiment to control the third secondary reaction, lead is replaced by cylindrical graphite rod as the cathode and the cathode compartment, limited to the stationary phase, is confined in an asbestos band wound with joining spirals around the cathode. But the graphite has a tendency to split in the persulfate bath and the asbestos diaphragm hardens and becomes fragile. This splitting tendency of the graphite is greater in electrolytic preparations of sodium persulfate which—with this design of the cell—can be made with an optimal electrical efficiency only if the cathode surface is slight, and therefore if the cathode density is high; destruction of the cathode is then so rapid that this use is difficult to effect under economically acceptable conditions.

Recently, the life of cathodes has been greatly increased by using zirconium or a zirconium base alloy instead of graphite (in the absence of fluorine impurities, zirconium is completely unattackable in this medium) and polyvinyl chloride base synthetic materials, acrylic polymers or polyolefins instead of asbestos.

Use of zirconium makes possible the fourth embodiment in which use is made of a cell, without a diaphragm, made of a zirconium pipe forming the cathode and cell in which anodes, made of a conductive metal rod sheathed with platinum, are immersed; the useful volume of the cell is slight, on the order of 1 liter; the electrolyte circulates therein at high speed; the cathode density is high so that it is possible to ascribe a diaphragm role to the hydrogen film that is formed on its surface; this type of cell is that which leads to obtaining ammonium persulfate with minimal electrical energy consumption.

However, this embodiment has several drawbacks:

The gas mixture that is released at the top of the cell has a composition in the range of explodable $H_2$-$O_2$ mixtures.

In electrolysis of ammonium bisulfate the current efficiency is greatly influenced by the persulfate concentration of the electrolyte and becomes almost zero for high concentrations; it is possible, to a certain extent, to improve this efficiency and bring it to acceptable values by using an imperfectly rectified current obtained from a single-phase alternating current and such that the rate of ripple of the rectified voltage is equal or close to 100%. This complicates the design of the rectified current generator and reduces its efficiency.

On the other hand, it is known that, with the cells described above, the formation of persulfate is influenced by the cation associated with bisulfate; current efficiency decreases in the direction of $Cs^+$, $K^+$, $NH_4^+$, $Na^+$, $Li^+$; for example, electrolytic preparation of sodium persulfate, with the cells described above, is not economically viable.

SUMMARY OF INVENTION

The present invention remedies all the drawbacks listed above, avoids cathode reduction of the persulfate ion and makes it possible to improve the current efficiency in considerable proportions.

According to the invention, the process of preparing peroxydisulfates of alkali metals or ammonium by anode oxidation, in a diaphragm electrolysis cell, of aqueous solutions of sulfate ions associated with protons, alkali or ammonium cations, is carried out in a diaphragm cell whose active part is made up of a cation exchange polymer. The active part is advantageously supported by a synthetic textile fabric or felt.

BRIEF DESCRIPTION OF THE DRAWING

The FIGURE is a graph showing the current densities vs. the current efficiencies of the electrolysis of various hydrogen sulfates.

DETAILED DESCRIPTION OF EMBODIMENTS

The cation exchange polymer can advantageously be selected from the resins with a sulfonated polystyrene base. The sulfonated polystyrene base resin can optionally be supported by a synthetic textile fabric or felt such as polypropylene. The product designated by the trademark "IONAC MC 3470," sold by the IONAC Chemical Company, is very satisfactory for the embodiment of the invention. "IONAC MC 3470" is a cation exchange membrane of 15 mils (0.4 mm) thickness, constituting sulfonated polystyrene supported by a polypropylene fabric, and having a specific weight of approximately 405 g/m$^2$; it has a capacity of approximately 1.22 meq/g and a resistance of 6 ohm/cm$^2$ for 1.0 N. NaCl.

The cation exchange polymers selected according to the invention constitute screens that are particularly fluid-tight to the persulfate ion. With such diaphragms, transport of the current is assured by $H^+$ and $M^+$ ions ($M^+$ being $NH_4^+$ or an alkali cation) which pass through the membrane while the dipersulfuric or persulfate anion $S_2O_8^=$ remains confined in the anode compartment.

As an anolyte there is used an aqueous solution of alkali hydrogen sulfate or ammonium hydrogen sulfate with the highest possible concentration of anion $HSO_4^-$. This concentration is selected as a function of further treatment which it is desired to make the persulfate solution undergo. It is possible either to make the solid persulfate crystallize by treating the anode solution by any suitable means such as, for example, continuous crystallization under reduced pressure; or else it is possible to work at bisulfate saturation and let the persulfate be precipitated in the anode compartment. It has actually been found that the current efficiency is high and almost constant in a wide range of concentration of $HSO_4^-$, e.g. on the order of 89 to 95% for sodium bisulfates and ammonium bisulfates.

On the cathode side, a concentrated aqueous sulfuric acid solution is initially used; in any event, in case of a continuous functioning and because of the passage in more or less solvate state, of the $NH_4^+$ or alkali ions through the diaphragm, the catholyte is, in equilibrium, a solution of sulfuric acid and bisulfate whose composition is a function particularly of the dilution of the anolyte.

Thus the persulfate is obtained with minimal electric energy consumption, i.e. less than 2 kWh/kg even for sodium persulfate.

Use of such a diaphragm makes it possible to operate at a very high anode current density without great reduction of the current efficiency; and the anode current densities are preferably between 50 and 500 A/dm$^2$.

Advantageously, a cell equipped with a diaphragm according to the invention makes it possible to use materials which are less rare, less burdensome, better conductors than zirconium and graphite, and with slight excess pressures by hydrogen at zero current, such as nickel and copper.

The following examples illustrate the invention in a non-limiting way.

EXAMPLE 1

Preparation of ammonium persulfate

A cell is used with two compartments separated by a diaphragm 34 cm$^2$ made up of a membrane of sulfonated polystyrene base resin supported by a polypropylene fabric sold under the trademark "IONAC MC 3470". The anode compartment receives an anode (copper rod 3 mm in diameter sheathed with Pt: useful surface 6.79 cm$^2$). The cathode compartment receives a cathode made up of a zirconium plate 45 cm$^2$ in surface.

The anolyte is a solution of 5 M ammonium hydrogen sulfate: 100 ml.

The catholyte is a 25% solution of sulfuric acid: 40 ml.

The anolyte is stirred by magnetic bar.

The current density on the anode is 100 A/dm$^2$.

The temperature is kept at 30°±1° C. in the anode compartment. A 50 g/l ammonium sulfocyanide solution is added therein at a rate of 0.5 ml initially and 0.1 ml every 10 minutes.

Four identical operations are performed, each time modifying the time of current passage; the results are shown in the following table:

| time of electrolysis | 20 mn | 40 mn | 60 mn | 80 mn |
|---|---|---|---|---|
| average voltage | 5.88 volts | 5.96 volts | 6.12 volts | 6.16 volts |
| $(NH_4)_2S_2O_8$ (a) | 83.5 g/l | 170.6 g/l | 256.1 g/l | 334.7 g/l |
| $H_2SO_5$ (b) | 1.2 g/l | 3.1 g/l | 8.8 g/l | 10.9 g/l |
| current efficiency | 85% | 84.7% | 83% | 80.3% |
| reduction of anolyte | 2.6% | 5.2% | 7.2% | 8.7% |
| energy consumption (kWh/kg persulfate) | 1.63 | 1.65 | 1.73 | 1.8 |

(a) and (b) concentration of anolyte in persulfate and monopersulfuric acid at end of electrolysis.

EXAMPLE 2

Ammonium persulfate

The operation is with the same cell as in Example 1 and under the same conditions, but there is placed in the anode compartment a solution containing 3.25 moles/liter of ammonium sulfate $(NH_4)_2SO_4$ and 1.75 moles/liter of $H_2SO_4$; in the cathode compartment is placed a solution of sulfuric acid at 4.5 moles/liter. After an hour operation with an anode current density of 50 to 150 A/dm$^2$ and an average voltage of 6.34 volts, a solution is obtained containing 273.9 g/l of ammonium persulfate $(NH_4)_2S_2O_8$ and 2.5 g/l of monopersulfuric acid $H_2SO_5$. Taking into account the reduction of the volume of the anolyte of 8.5%, this corresponds to a current efficiency of 87.6% for an energy consumption of 1.7 kWh/kg persulfate.

EXAMPLE 3

Sodium persulfate

In the same cell as that of Example 1, a sodium hydrogen sulfate solution $NaHSO_4$ at 5.5 moles/liter is electrolyzed; 0.5 ml of a solution of sodium sulfocyanide NaSCN at 50 g/l is added. Then 0.1 ml of the same solution is added every ten minutes. The catholyte is a 25% sulfuric solution. After an hour of electrolysis with an anode current density of 100 A/dm$^2$ and a voltage of 6.6 volts, a solution of 261 g/l is obtained which corresponds to a current efficiency of 78.3% and an energy consumption of 1.89 kWh/g.

EXAMPLE 4

Sodium persulfate

Under the same conditions as in Example 3 but with an anode current density of 70 A/dm$^2$ there is obtained, after an hour of electrolysis under a voltage of 5.6–5.8 volts, a solution containing 185.4 g/l of sodium persulfate corresponding to a current efficiency of 81% and an energy consumption of 1.65 kWh/g persulfate.

EXAMPLE 5

Sodium persulfate (nickel cathode)

The same cell is used that of Example 1 in which the zirconium plate is replaced by a nickel cathode of the same surface. Operating under the same conditions as in Example 3, the following results are obtained:

| Time of electrolysis | 20 mn | 80 mn |
|---|---|---|
| Average voltage | 6.3 | 6.5 |
| $Na_2S_2O_8$ (g/l) (a) | 82.6 | 328.5 |
| $H_2SO_5$ (g/l) (b) | 0.8 | 4.8 |
| Current efficiency | 81.5 | 76.9 |
| Reduction of volume of anolyte | 1.3 | 7 |
| Energy consumption (kWh/kg persulfate) | 1.7 | 1.9 |

(a) and (b) concentration in anolyte at end of electrolysis.

EXAMPLE 6

A three compartment cell is used, the anode compartment being placed between the two cathode compartments and separated from them by two diaphragms of "IONAC MC 3470". The anode is made of 50 cm of platinum wire (diameter 0.3 mm; surface 4.24 cm$^2$); the cathodes are zirconium plates; the total surface of the diaphragm is 75 cm$^2$, that of the cathode 72 cm$^2$; the interpolar distances are reduced to a minimum (anode—diaphragm: 5 mm, diaphragm—cathode: 10 mm).

The table below and the graph of the accompanying drawing give the results obtained from two anolytes: sodium hydrogen sulfate $NaHSO_4$ (6 moles/liter) and ammonium hydrogen sulfate $NH_4HSO_4$ (6 moles/liter); the anolyte temperature is kept at 20° C. by cooling by circulation on an external exchanger.

The nature of the anolyte is shown given in column 1; the current densities on the anode designated by d given in amperes per square decimeter A/dm$^2$ appear in column 2; the average voltages U in volts are indicated in column 3; the amounts of persulfates in grams/liter produced at the end of the test [$M_2S_2O_8$] g/l are shown in column 4; the current efficiencies RF expressed in percentages are grouped in column 5; the energy consumed per kg of persulfate produced W/kg is found in column 6; and the times of electrolysis t in minutes are in column 7.

| Anolyte | d A/dm$^2$ | U volts | [$M_2S_2O_8$] | RF kwh | W/kg | t m |
|---|---|---|---|---|---|---|
| $NaHSO_4$ | 75 | 4.3 | 130 g/l | 89.5% | 1.1 | 65 |
| " | 100 | 4.5 | 137 | 87.9 | 1.2 | 52 |
| " | 150 | 5.1 | 138 | 87.2 | 1.3 | 35 |
| " | 200 | 5.5 | 134 | 86.9 | 1.4 | 26 |
| " | 250 | 5.9 | 131.5 | 83.6 | 1.6 | 21 |
| $HNH_4SO_4$ | 75 | 4.2 | 88 | 94.5 | 1 | 43 |
| " | 200 | 4.9 | 88 | 93.1 | 1.2 | 17 |
| " | 250 | 5.3 | 89 | 93.2 | 1.3 | 13 |

In graph 1 there are plotted on the abscissas the current densities A/dm$^2$, on the ordinates the current efficiencies RF% and energy consumption CP in kWh/kg/ Curves 1 and w correspond to energy consumptions CP in relation to the current density respectively for ammonium hydrogen sulfate (curve 1) and sodium hydrogen sulfate (curve 2). Curves 3 and 4 represent the current efficiency CF% in relation to the current density respectively for sodium hydrogen sulfate (curve 3) and for ammonium hydrogen sulfate (curve 4).

It should be understood that while several embodiments of the present invention have been illustrated and described herein, numerous other variations or modifications therein may occur to those having skill in this art; and what is intended to be covered herein is not only the illustrated forms of the present invention, but also any and all modified forms thereof as may come within the spirit of said invention.

What is claimed is:

1. In a process for preparing peroxydisulfates of alkali metals or ammonium by anode oxidation in a diaphragm electrolysis cell of aqueous solution of sulfate ions associated with protons, alkali cations or ammonium, the improvement wherein the active part of the diaphragm is a sulfonated polystryrene base cation exchange resin having a capacity of approximately 1.22 meq/g, supported by a polypropylene fabric, and said diaphragm being substantially impermeable to the persulfate anion $S_2O_8$=.

2. Process of preparing peroxydisulfates of alkali metals or ammonium according to claim 1 wherein the sulfonated polystyrene is supported by a polypropylene fabric.

3. Process of preparing peroxydisulfates of alkali metals or ammonium according to claim 1 wherein the anolyte is an aqueous solution of alkali hydrogen sulfate or ammonium with the highest possible concentration of $HSO_4^-$ anion, and the catolyte is a sulfuric acid solution.

4. Process of preparing perosydisulfates of alkali metals or ammonium according to claim 3 wherein the anode current density is between 50 and 500 A/dm$^2$.

5. Process according to claim 1, wherein said cell has three compartments comprising an anode compartment located between two cathode compartments and separated therefrom by two of said diaphragms.

6. Process according to claim 1, wherein said diaphragm is substantially 15 mils thick, has a specific weight of approximately 405 g/m$^2$, and a resistance of 6 ohm/cm$^2$ for 1.0 N. NaCl.

* * * * *